US007392006B2

(12) United States Patent
Kameda et al.

(10) Patent No.: US 7,392,006 B2
(45) Date of Patent: Jun. 24, 2008

(54) IMAGE HEATING APPARATUS

(75) Inventors: Seiichiro Kameda, Abiko (JP); Junichi Moteki, Abiko (JP); Youichi Chikugo, Toride (JP); Shinichiro Hosoi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 241 days.

(21) Appl. No.: 11/455,860

(22) Filed: Jun. 20, 2006

(65) Prior Publication Data

US 2007/0059060 A1 Mar. 15, 2007

(30) Foreign Application Priority Data

Sep. 13, 2005 (JP) ..... 2005-265875

(51) Int. Cl.
*G03G 15/20* (2006.01)

(52) U.S. Cl. ..... 399/329; 399/122

(58) Field of Classification Search ..... 399/107, 399/122, 320, 328, 329; 219/216
See application file for complete search history.

(56) References Cited

U.S. PATENT DOCUMENTS 5,278,618 A * 1/1994 Mitani et al. ..... 399/329
6,359,269 B1 * 3/2002 Hayasaki et al. ..... 219/665
6,373,232 B1 * 4/2002 Mano et al. ..... 323/282

FOREIGN PATENT DOCUMENTS

JP 61-132972 6/1986
JP 11-194642 7/1999

* cited by examiner

*Primary Examiner*—Hoan H Tran
(74) *Attorney, Agent, or Firm*—Fitzpatrick, Cella, Harper & Scinto

(57) ABSTRACT

An image heating apparatus includes a heating rotatable member for heating an image on a recording material at a nip; an endless belt cooperative with the heating rotatable member to form the nip; a pressing pad for pressing the belt at the nip; and a lubricant application member for applying a lubricant on an inner surface of the belt, wherein the lubricant application member is away from the belt when the belt is at a position retracted from a position where an image heating operation of the apparatus is capable.

5 Claims, 13 Drawing Sheets

(1st STATE)

(2nd STATE)

IMAGE HEATING APPARATUS

FIELD OF THE INVENTION AND RELATED ART

The present invention relates to an image heating apparatus for heating an image on recording medium. As examples of an image heating apparatus, a fixing apparatus for fixing an unfixed image on recording medium, an apparatus for increasing a fixed image on recording medium in glossiness by heating the fixed image on the recording medium, etc., can be listed. An image heating apparatus is employed by a copying machine, a printing machine, a facsimile machine, etc.

A so-called belt-based fixing apparatus, that is, a fixing apparatus which employs a fixation roller and a pressure application belt has been devised (Japanese Laid-open Patent Applications 61-132972 and 11-194642).

A belt-based fixing apparatus forms a fixation nip by its fixation roller and pressure application belt. Therefore, it can provide a fixation nip which is greater in width (dimension in terms of recording medium conveyance direction) than that provided by a fixing apparatus which employs a fixation roller and a pressure roller. Thus, a belt-based fixing apparatus makes it possible to improve an image forming apparatus in image formation speed, compared to a conventional fixing apparatus, that is, a fixing apparatus which employs a pressure roller instead of a pressure application belt.

A belt-based fixing apparatus such as the one described above is structured so that pressure is applied to its pressure application belt by its pressure application pad, in its fixation nip. Therefore, in order to reduce the amount of frictional resistance between the pressure application pad and pressure application belt, not only is the pressure application pad is covered with a piece of low friction resin sheet, but also, the inward surface (in terms of pressure application belt loop) of the pressure application belt is coated with lubricant by a lubricant application member.

While a belt-based fixing apparatus such as the one described above is on standby, its pressure application belt is kept separated from the fixation roller in order to prevent the image forming apparatus from yielding a defective image.

However, in the case of a belt-based fixing apparatus structured in accordance with the prior art, its lubricant application member remains in contact with its pressure application belt even while the fixing apparatus is on standby. Thus, when the length of time the fixing apparatus is kept on standby is long, the problem that lubricant is unsatisfactorily applied, the problem that the lubricant application member is reduced in service life, and/or the like problems sometimes occurred.

SUMMARY OF THE INVENTION

The object of the present invention is to provide an image heating apparatus, the belt of which is consistently coated with lubricant in a satisfactory fashion.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the present invention will be concretely described with reference to the following preferred embodiments of the present invention. Incidentally, although the following preferred embodiments of the present invention are examples of the most preferable embodiment of the present invention, they are not intended to limit the scope of the present invention in terms of apparatus structure. In other words, not only is the present invention compatible with the structural arrangements for a belt-based fixing apparatus, in the preferred embodiments of the present invention described below, but also, the various known structural arrangements for a belt-based fixing apparatus other than those in the preferred embodiments.

Embodiment 1

(1) Example of Image Forming Apparatus

Figure 8:
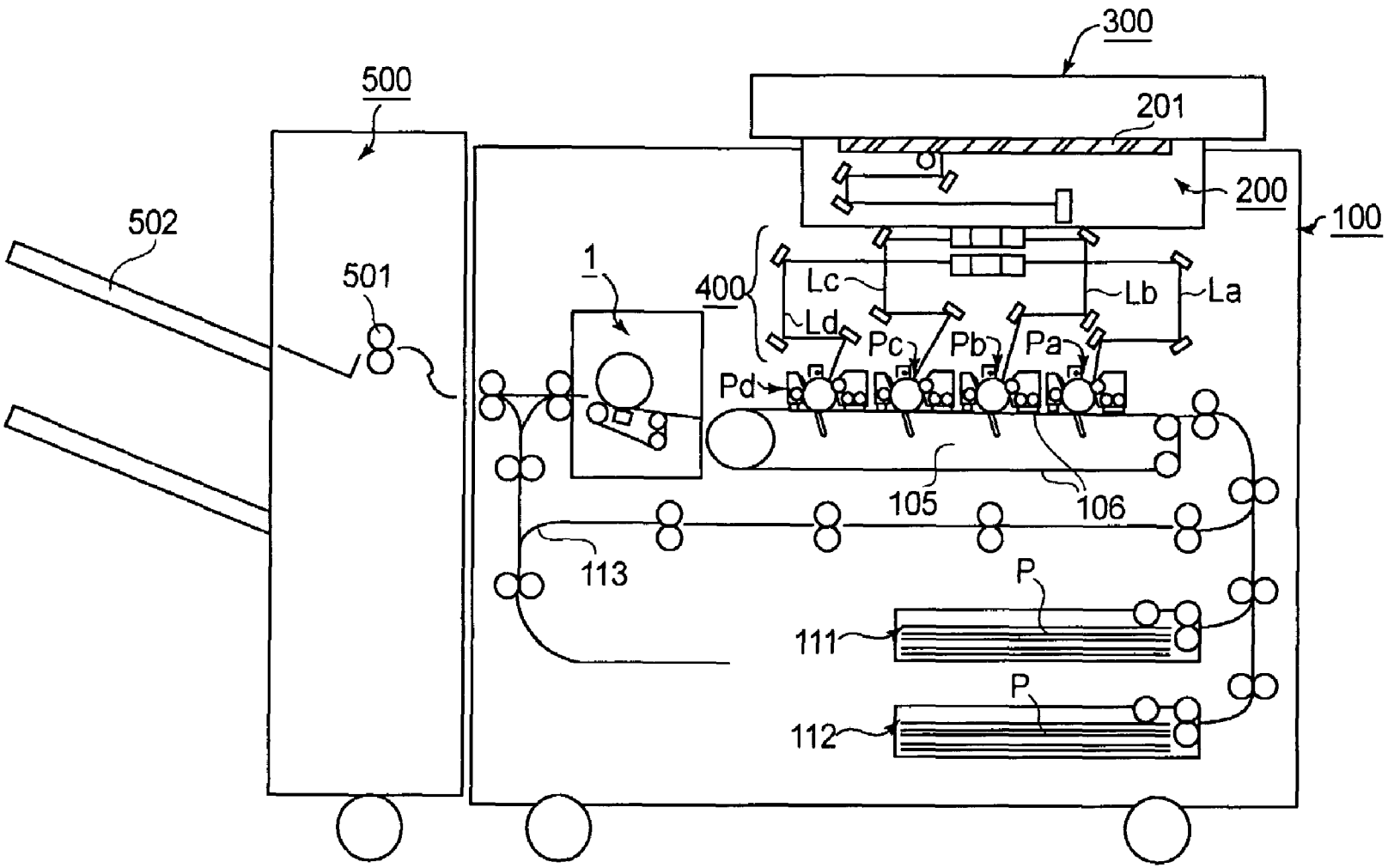
FIG. 8 is a schematic sectional view of an example of an image forming apparatus in accordance with the present invention, showing the general structure thereof.
Figure 9:
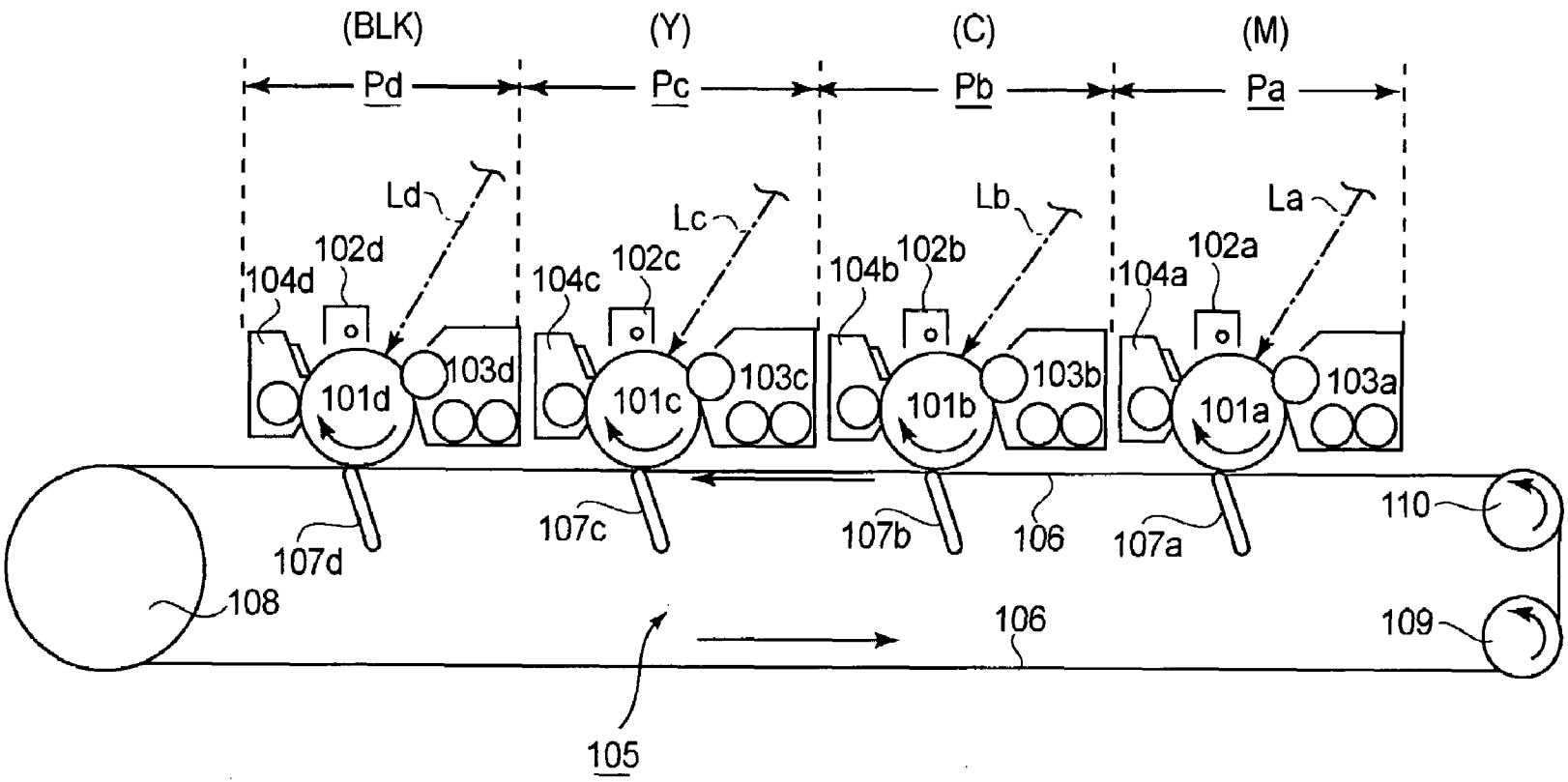
FIG. 9 is an enlarged schematic sectional view of the image forming station of an image forming apparatus in accordance with the present invention.

FIG. 8 is a schematic sectional view of an example of an image forming apparatus equipped with an image heating apparatus, as a fixing apparatus, in accordance with the present invention, showing the general structure thereof. FIG. 9 is an enlarged view of the image forming stations of the image forming apparatus shown in FIG. 8.

The image forming apparatus in this embodiment employs an electrophotographic process. It is a color printer, which has multiple optical scanning means and four drums disposed in tandem.

This printer is provided with an image reader 200, which is disposed in the top portion of the main assembly 100 of the image forming apparatus. The image reader 200 reads an original (color image); it processes the optical image of the color original to obtain the information necessary to form a copy of the color original. More specifically, it separates the optical image of the color original into multiple monochromatic images with its photoelectric transducers such as CCDs. Designated by a referential symbol 300 is an automatic original feeding apparatus, which automatically feeds an original onto the original placement glass platen of the image reader 200, or an original placement glass platen on which an original is flatly placed by applying pressure on the original.

Designated by referential symbols Pa, Pb, Pc, and Pd are four image forming stations, which form four monochromatic images, that is, magenta, cyan, yellow, and black monochromatic color images, respectively.

Referring to FIG. 9, in the image forming stations Pa, Pb, Pc, and Pd, photosensitive drums 101*a*, 101*b*, 101*c*, and 101*d* are disposed, respectively, which are rotated in the direction indicated by arrow marks in the drawings. In the adjacencies of the peripheral surfaces of the photosensitive drums 101*a*, 101*b*, 101*c*, and 101*d*, charging devices 102*a*, 102*b*, 102*c*, and 102*d*, developing apparatuses 103*a*, 103*b*, 103*c*, and 103*d*, and cleaners 104*a*, 104*b*, 104*c*, and 104*d* are disposed, respectively, listing upstream to downstream in terms of the rotational direction of the photosensitive drums.

Below the photosensitive drums 101, a transferring apparatus 105 is disposed. The transferring apparatus 105 has a transfer belt 106 and transfer charging devices 107*a*, 107*b*, 107*c*, and 107*d*. The transfer belt 106 is a recording medium conveying means, and is common to all the image forming stations P. It is an endless belt, and is stretched around three rollers, that is, a driver roller 108 and turn rollers 109 and 110, being thereby suspended by them.

The image forming stations 101 use an electrophotographic process, which includes the process of exposing the peripheral surfaces of the photosensitive drums 101*a*, 101*b*, 101*c*, and 101*d* with beams La, Lb, Lc, and Ld of laser light outputted from the abovementioned laser scanning portion 400 in a manner of scanning the peripheral surfaces of the photosensitive drums 101*a*, 101*b*, 101*c*, and 101*d*. As a result, monochromatic magenta, cyan, yellow, and black color images are formed on the peripheral surfaces of the photosensitive drums 101*a*, 101*b*, 101*c*, and 101*d*, of magenta, cyan, yellow, and black toners, respectively.

Referring to FIG. 8, designated by referential symbols 111 and 112 are first and second sheet feeder cassettes disposed in the main assembly 100 of the printer. The sheets of recording medium P (transfer paper, copy paper, OHP sheet, etc.) are stored in the sheet feeder cassette 111 or 112, and are fed one by one into the main assembly 100 of the printer by a recording medium feeding means. As each sheet of recording medium P (which hereafter will be referred to simply recording medium P) is fed into the main assembly 100 of the printer, it is supported by the top surface of the transfer belt 106, and is sequentially conveyed through the image forming stations Pa, Pb, Pc, and Pd. While the recording medium P is conveyed through the image forming stations, Pa, Pb, Pc, and Pd, the monochromatic images, different in color, formed on the photosensitive drums 101*a*, 101*b*, 101*c*, and 101*d* are sequentially transferred in layers onto the recording medium P.

After the completion of this process of transferring the toner images, the recording medium P is separated from the transfer belt 106, and is conveyed to a fixing apparatus 1, which is a belt-based image heating apparatus in accordance with the present invention, and which will be described in detail in Section (2).

After being transferred onto the recording medium P, the toner images on the recording medium P are fixed to the surface of the recording medium P by the heat and pressure applied to the recording medium and the toner images thereon in the fixing apparatus 1, effecting thereby a permanent full-color image on the recording medium. Then, the recording medium P with the fixed toner images (full-color image) is discharged by a pair of sheet conveyance rollers 501 onto a delivery tray 502, which is vertically (downwardly) movable so that a large number of recording mediums P can be stored in layers as they are discharged onto the delivery tray 502. The printer is also provided with a paper processing apparatus 500, making it possible to processing (for example, stapling) multiple recording mediums P after they are discharged from the main assembly 100 of the printer.

When the printer is in the monochromatic black image forming mode, or the black-and-while mode, only the image forming station Pd, or the image forming station for forming a black image, is used for image formation. When the printer is in the two-sided copy mode, the recording medium conveyance path is switched after the recording medium P comes out of the belt-based fixing apparatus 1; as the recording medium P bearing a fixed image on one of the surfaces comes out of the fixing apparatus 1, it is conveyed to the reversing-and-refeeding mechanism 113, instead of the recording medium conveyance path for the single-sided copy mode. While the recording medium P is conveyed through the reversing-and-refeeding path, it is placed upside down, and then, is placed again on the transfer belt 106. Thus, a toner image is transferred (or toner images are transferred) onto the other surface of the recording medium P. Then, the recording medium P is reintroduced into the fixing apparatus 1. Thereafter, the recording medium P is conveyed as a two-sided copy to the paper processing apparatus 500.

(2) Fixing Apparatus 1

The fixing apparatus 1 in this embodiment is an image heating apparatus in accordance with the present invention. Regarding the direction of the fixing apparatus 1 and the directions of the structural members of the fixing apparatus 1, their lengths and their lengthwise directions means their dimensions and their directions, respectively, in terms of the direction parallel to the direction perpendicular to the recording medium conveyance direction.

Figure 1:
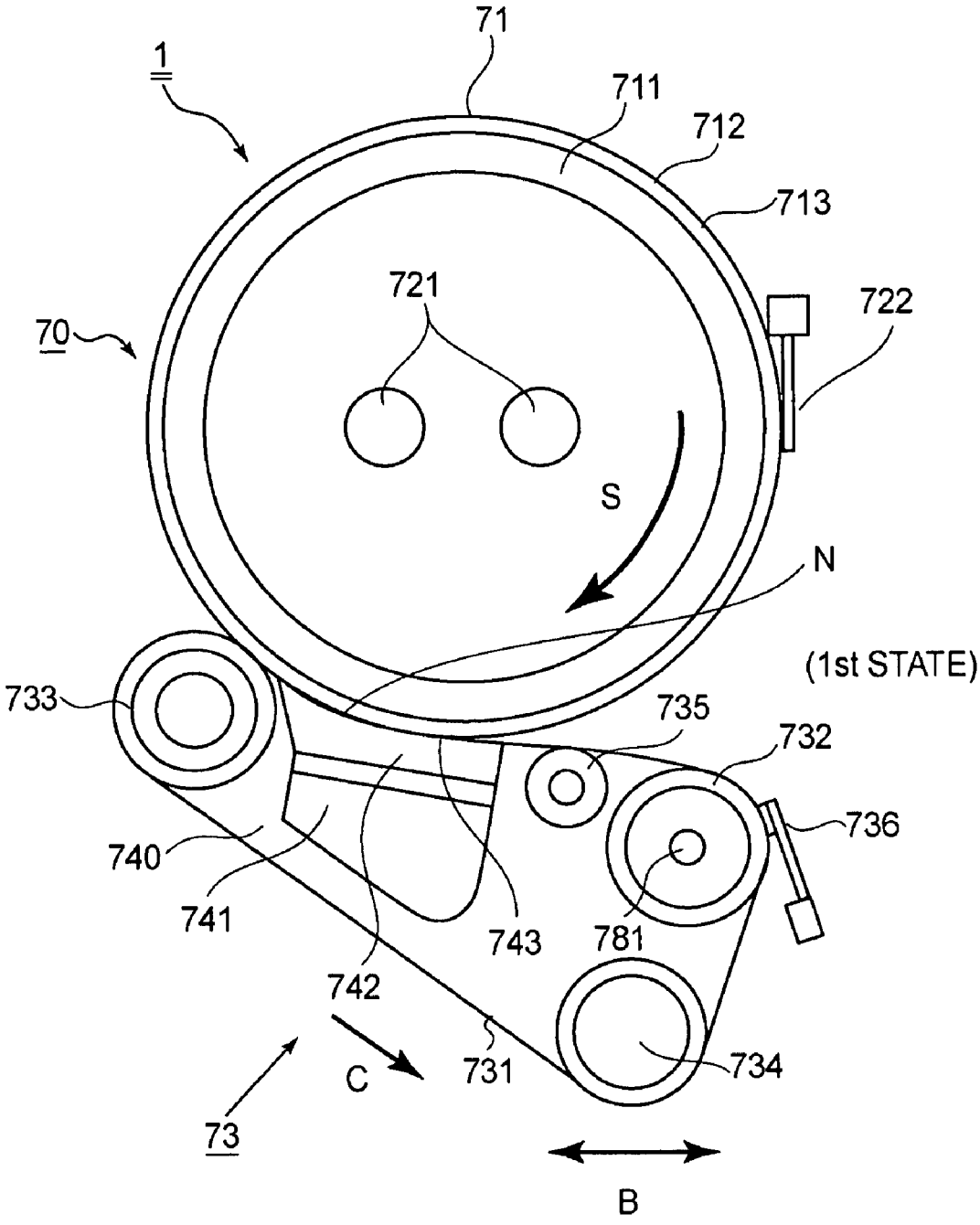
FIG. 1 is a schematic sectional view of the fixing apparatus in the first embodiment of the present invention.

Referring to FIG. 1, the fixing apparatus 1 is made up of a fixation roller 70 and a fixation belt unit 73. The fixation roller 71 is a rotational heating member. It is made up of a metallic core 711, an elastic layer 712, and a release layer 713. The metallic core 711 is formed of aluminum or the like. The elastic layer 712 is formed on the peripheral surface of the metallic core 711, of silicon rubber. The release layer 713 constitutes the surface layer of the fixation roller 70, and is formed of a piece of PFT tube for improving the fixation roller 711 in terms of toner release.

The fixation roller 71 is rotated by an unshown driving mechanism in the direction indicated by an arrow mark S at a preset peripheral velocity. In the hollow of the fixation roller 71, a pair of heaters 721 are disposed near the axial line of the fixation roller 71. As electric power is supplied to these heater 721, the heaters 721 heat up, heating thereby the fixation roller 71 from within the fixation roller 71. The surface temperature of the fixation roller 71 is measured by a thermistor 722. The signals representing the surface temperature detected by the thermistor 722 is inputted into a control circuit (unshown). The control circuit controls the power supply to the heaters 721 so that the detected surface temperature (information) of the fixation roller 71 inputted from the thermistor 722 to the control circuit is maintained at a preset fixation temperature.

The fixation belt unit 73 has a fixation belt 731, which is circularly rotatable endless belt. The fixation belt 731 is stretched around multiple belt stretching-and-suspending members, more specifically, an entrance roller 732, a separation roller 733, and a steering roller 734. The fixation belt unit 73 has also a pressure application pad 740, as a pressure applying member, which is disposed inside the fixation belt loop. The fixation belt unit 73 and fixation roller 71 forms a fixation nip N (heating nip). The fixation belt unit 73 makes it possible to form a fixation nip which is wider (in terms of recording medium conveyance direction) than the fixation nip which a pressure roller can, making it therefore possible to better melt the toner on recording medium. Therefore, a fixing apparatus employing the fixation belt unit 73 is preferable choice for a color image forming apparatus, that is, an image forming apparatus which uses a large amount of toner.

The fixation belt unit 73 is also provided with a belt heater 781, which is disposed within the hollow of the entrance roller 732 (first roller), being located near the axial line of the entrance roller 732. As electric power is supplied to this heater 781, the heater 781 generates heat, heating thereby the entrance roller 732 from within the entrance roller 732. Thus, the rotational fixation belt 731 is heated by the heat from the entrance roller 732. The surface temperature of the fixation belt 731 is measured by a thermistor 736 disposed near the entrance roller 732. The signals representing the surface temperature of the fixation belt 731 detected by the thermistor 736 are inputted into the control circuit, which controls the electric power supply to the heater 781 so that the detected surface temperature (information) of the fixation belt 731, which is inputted from the thermistor 736, is maintained at the preset fixation belt temperature.

The separation roller 733 (second roller) is formed of metal. It is pressed against the fixation roller 71 by a pressure applying means, with the fixation belt 731 placed between the separation roller 733 and fixation roller 71. Thus, the elastic layer 712 of the fixation roller 71 is deformed by the pressure applied to the separation roller 733. Therefore, the portion of the fixation nip N, which coincides with the contact area between the separation roller 733 and fixation belt 731, becomes opposite to the rest of the fixation nip N, in terms of the direction of curvature. The toner on recording medium is melted and pressed in the fixation nip N. Therefore, the toner on recording medium and the surface layer of the fixation roller 71 are made to adhere to each other, by the surface tension of the toner, while the toner is in the melted condition in the fixation nip N. However, the portion of the fixation nip N, which coincides with the contact area between the separation roller 733 and fixation belt 731, is opposite to the rest of the fixation nip N, in terms of the direction of curvature, as described above. Therefore, the toner having adhered to the fixation roller 71 is separated from the fixation roller 71, allowing thereby the recording medium to separate from the fixation roller 71. Thereafter, the recording medium P is discharged from the main assembly 100 of the printer.

Figure 2:
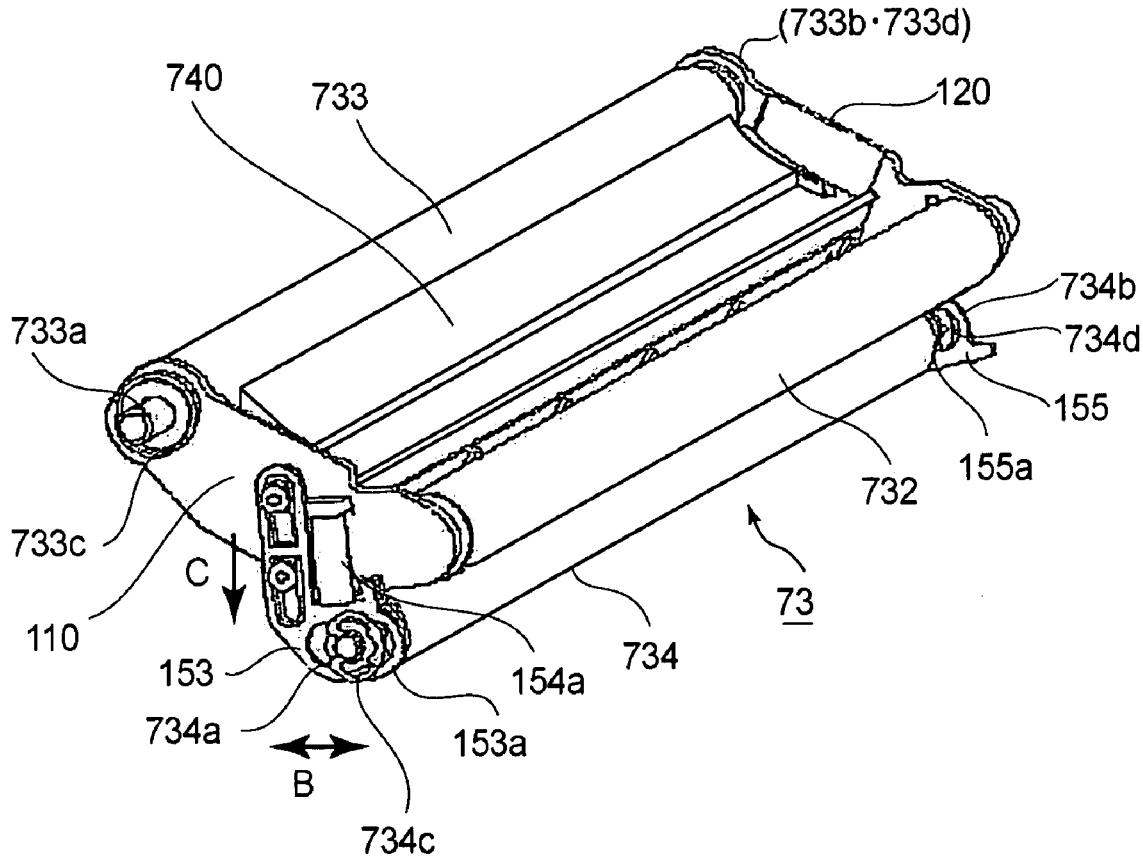
FIG. 2 is an external perspective view of the fixation belt unit 73.

FIG. 2 is an external perspective view of the fixation belt unit 73. The fixation belt unit 73 is fixed to the pressure application pad unit 740; the front and rear plates 110 and 120 of the fixation belt unit 73 are attached to the pressure application pad unit 740. The entrance roller 732 is rotatably supported by the front and rear plates 110 and 120 of the fixation belt unit 73. The lengthwise end portions 733*a* and 733*b* of the separation roller 733 are fitted with bearings 733*c* and 733*d*, respectively.

The lengthwise end portion 734*a* of the steering roller 734 is fitted with a bearing 734*c*, which is fitted in the elongated hole 153*a* of a pressure application front arm 153. Therefore, the steering roller 734 is allowed to move relative to the elongated hole 153*a* of the pressure application front arm 153, in the direction indicated by an arrow mark B. The pressure application front arm 153 is under the pressure generated by a pressure application spring 154*a* in the direction indicated by an arrow mark C. Thus, the pressure application front arm 153 presses the steering roller 734 in the direction of the arrow mark C, providing thereby the fixation belt 731 with tension.

Similarly, on the rear plate side of the fixation belt unit 73, the other lengthwise end portion 734*b* of the steering roller 734 is fitted with a bearing 734*d*, which is fitted in the elongated hole 155*a* of a pressure application rear arm 155. Therefore, the steering roller 734 is allowed to move relative to the elongated hole 155*a* of the pressure application rear arm 155, in the direction indicated by the arrow mark B. The pressure application rear arm 155 is under the pressure generated by a pressure application spring (unshown) in the direction indicated by the arrow mark C. Thus, the pressure application rear arm 155 presses the steering roller 734 in the direction of the arrow mark C, providing thereby the fixation belt 731 with tension.

As the fixation belt unit 73 is moved away from the fixation roller 71, the steering roller 734 moves in the direction of the arrow mark C, as will be described later, because the steering roller 734 is kept pressured by the pressure application spring 154*a* in the direction of the arrow mark C. This movement of the steering roller 734 provides the fixation belt 731 with tension. Therefore, even if the fixation belt unit 73 is moved away from the fixation roller 71, the fixation belt 731 remains stretched around the entrance roller 732, separation roller 733, and steering roller 734, without slackening.

The steering roller 734 is rendered pivotally movable so that its lengthwise ends move in the direction of the arrow mark B, as described above. The movement of the steering roller 734 is controlled by an unshown steering roller rocking mechanism in order to prevent the problem that the fixation belt 731 excessively deviates in its width direction while it rotates.

The pressure application pad unit 740 is made up of: a base 741 formed of a metal such as SUS; a pressure application pad 742 formed of silicon rubber or the like; a low friction sheet 743, which is formed of PI film or the like, and is placed between the pressure application pad 742 and fixation belt 731; etc.

Between the entrance roller 732 and pressure application pad unit 740, an oil application roller 735 as a lubricant application member for coating the inward surface of the fixation belt 731 with lubricant (oil) is disposed. The oil application roller 735 is located between the front and rear plates 110 and 120 of the fixation belt unit 73, and is rotatably attached to the two plates 110 and 112, which constitute the frame of the fixation belt unit 73. The lubricant application member 735 is not required to be in the form of a rotatable roller; it may be a nonrotational member.

The primary structural components of the oil application roller 735 are: an axle; an oil retaining layer formed around the axle; and an oil application amount controlling layer formed around the peripheral surface of the oil retaining layer, of porous film. The end surfaces of the oil applying roller 735 are covered with the extensions of the oil application amount controlling layer (porous film), which are folded in a manner to cover the end surfaces.

As for the material for the abovementioned lubricant, silicone oil is preferably used from the standpoint of heat resistance. Regarding the viscosity of the silicone oil, the most suitable silicone oil in terms of viscosity is selected according to the fixing apparatus usage conditions. However, the silicone oils which are very high in viscosity, are inferior in fluidity (it is difficult to apply). Normally, therefore, silicone oils which are no more than 30,000 cSt, are used as the lubricants for the fixation belt 731. As for concrete examples of the silicone oil as the lubricant for the fixation belt 731, dimethyle silicone oil, amino-modified silicone oil, fluorine-modified silicone oil, and the like can be listed. However, the materials for the lubricant for the fixation belt 731 do not need to be limited to these substances.

As examples of the materials for the axle, aluminum, iron, stainless steel, brass, etc., can be listed.

The abovementioned oil retaining layer is a layer which retains the major portion of the oil to be applied by the oil application roller 735. The oil in this layer seeps outward through the oil application amount control layer, and is transferred onto the inward surface of the fixation belt 731, etc.

As examples of the material for the oil retaining layer, sponge, organic or inorganic porous substance such as porous ceramic, organic or inorganic woven or nonwoven fiber such as paper or fabric, etc., which are placeable around the axle in a manner to wrap the axle, can be listed. Among those listed above, nonwoven fabric made of polyester fiber is preferably used.

The oil application amount control layer is provided to allow the oil in the oil retaining oil to seep outward by a proper amount (minuscule amount) as the oil permeates outward through an oil transfer layer, with which the oil application roller is provided as necessary, as will be described later. As the material for the oil application amount control layer, normally, porous film is used; polytetrafluoroethylene film (which hereafter will be referred to simply as porous PTFE film) is preferably used.

As for the properties of the abovementioned porous film, the porous film is desired to be 15-130 μm in thickness, 0.1-2 μm in average pore diameter, 0.5-2.0 μm in surface roughness, and 60-90% in porosity. Regarding air permeability, porous films which are 3-1,500 (sec/100 cc) in Gurley Number (measured by a Gurley densimeter of B type), are preferable used.

A precursor of an oil application roller, that is, a roller structured as described above, which has not been impregnated with oil, is impregnated with oil to make it into an oil application roller.

The application of oil to the inward surface of the fixation belt 731 by the abovementioned oil application roller 735 reduces the friction between the fixation belt 731 and low friction sheet 743.

Next, referring to FIG. 3, the positional relationship between the fixation roller 71 and fixation belt unit 73 while the fixation roller 71 and fixation belt unit 73 are kept pressed against each other (first state) will be described.

A line E is a straight line (imaginary line), which coincides with the line which is tangent to the top side of the peripheral surface of the entrance roller 732 and the bottom side of the peripheral surface of the fixation roller 71. The oil application roller 735 is disposed so that the top portion of its peripheral surface is above this line E (on opposite side of line E from inward side of belt loop).

A line F is a straight line (imaginary line), which coincides with the line which is tangent to the top side of the peripheral surface of the entrance roller 732 and the top side of the peripheral surface of the separation roller 733. The oil application roller 735 is disposed so that the top portion of its peripheral surface is below this line F (on fixation belt side of line F).

In other words, the oil application roller 735 is positioned so that it presses outward (relative to belt loop) the portion of the fixation belt 731, which is between the upstream edge (in terms of recording medium conveyance direction) of the pressure application pad unit 740, and the entrance roller 732, which is on the upstream side (in terms of recording medium conveyance direction) of the fixation nip N. Further, the oil application roller 735 is positioned on the inward side (relative to fixation belt loop) of the portion of the fixation belt 731, which is between the entrance roller 732, and the separation roller 733 which is on the downstream side (in terms of recording medium conveyance direction) of the fixation nip N.

Figure 3:
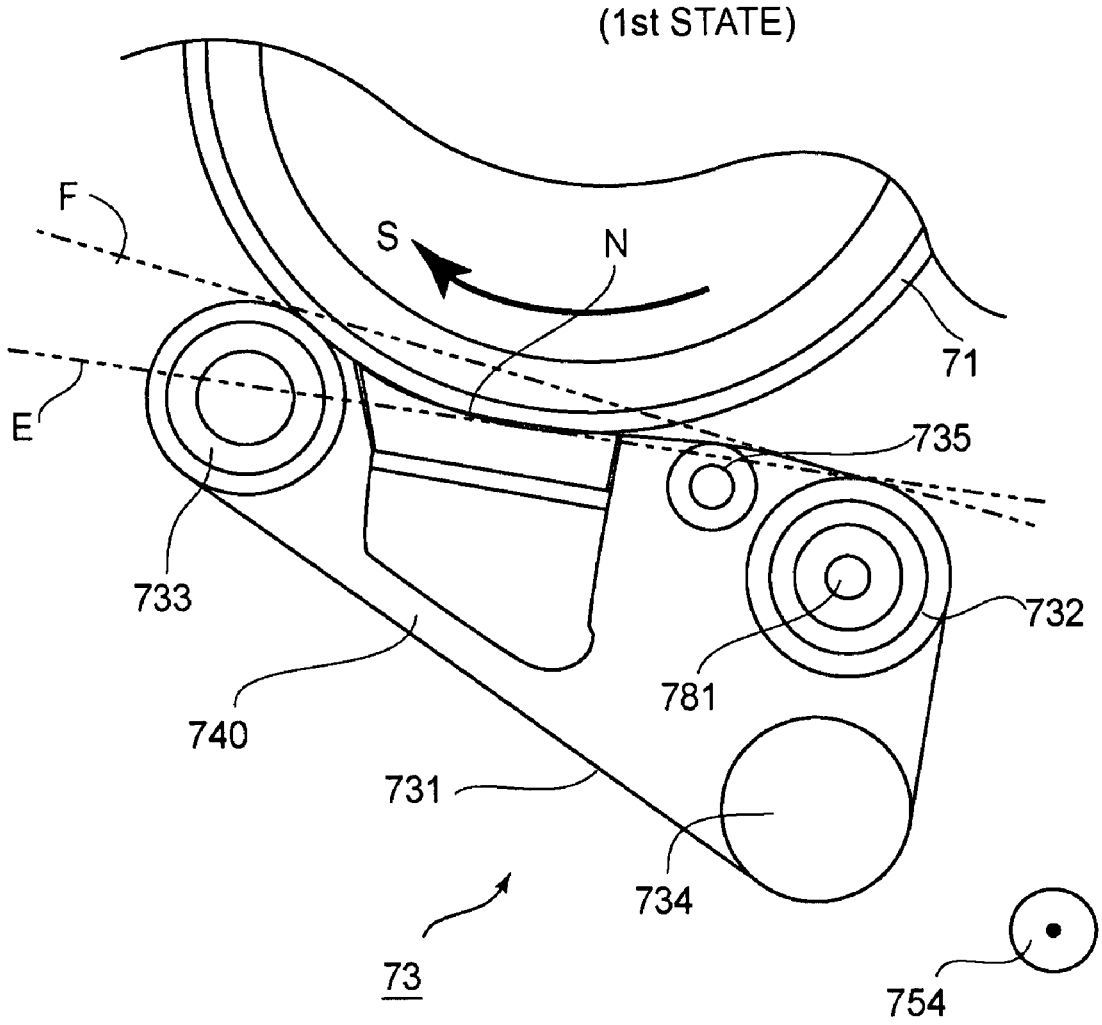
FIG. 3 is an enlarged view of a part of FIG. 1.
Figure 4A:
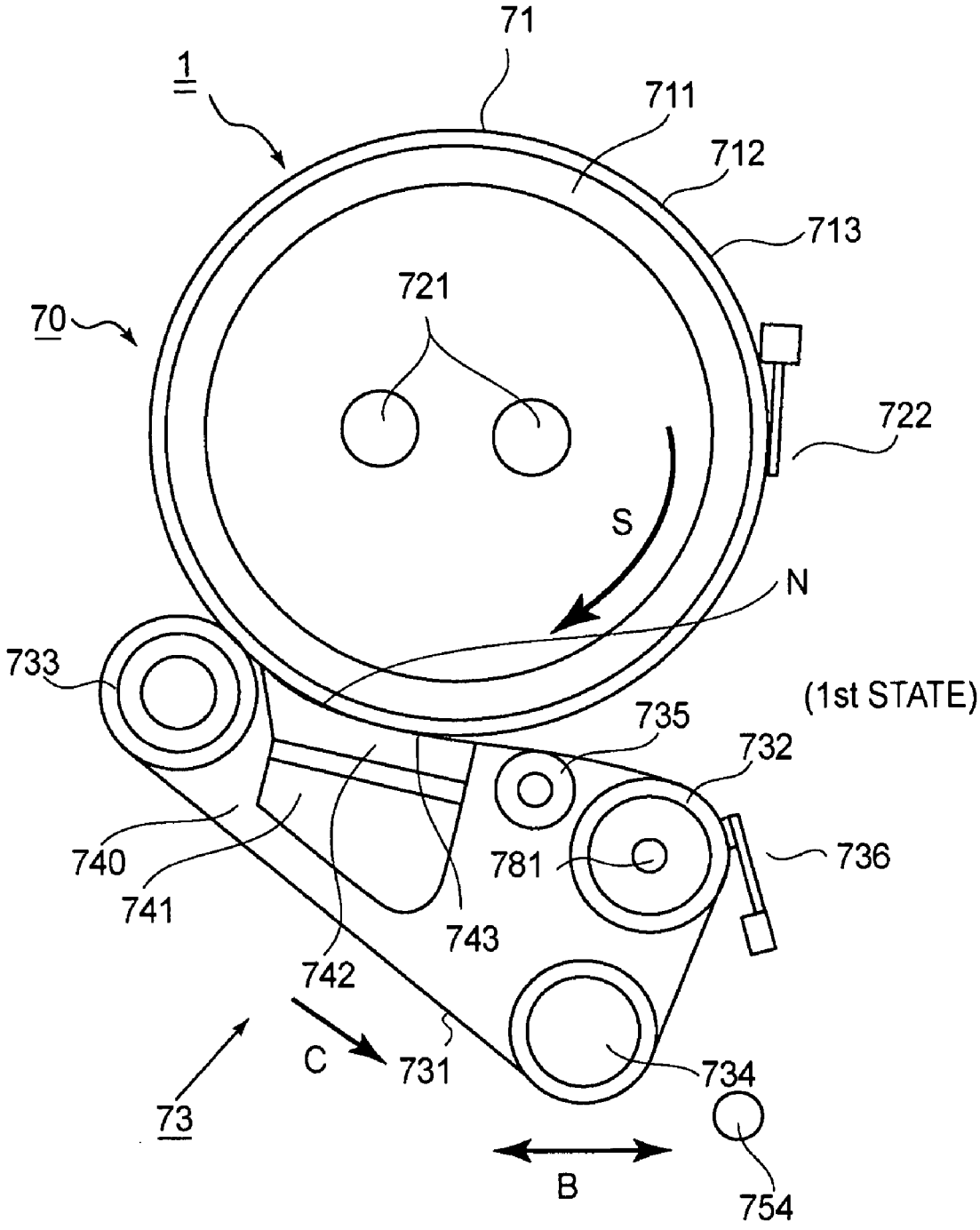
FIG. 4A is a schematic sectional view of the fixing apparatus in the first embodiment of the present invention, which is in the first state.

Referring to FIGS. 1, 3 and 4*a*, the structure described above positions the top portion of the peripheral surface of the oil application roller 735 above the line E (on outward side of loop which fixation belt would form if it were not for oil application roller 735). Therefore, it is assured that the oil application roller 735 remains in contact with the inward surface of the fixation belt 731. Therefore, it is assured that the oil in the oil application roller 735 is transferred by a preset amount onto the inward surface of the fixation belt 731 to prevent the fixation belt 731 from being worn from its inward surface side.

Figure 4B:
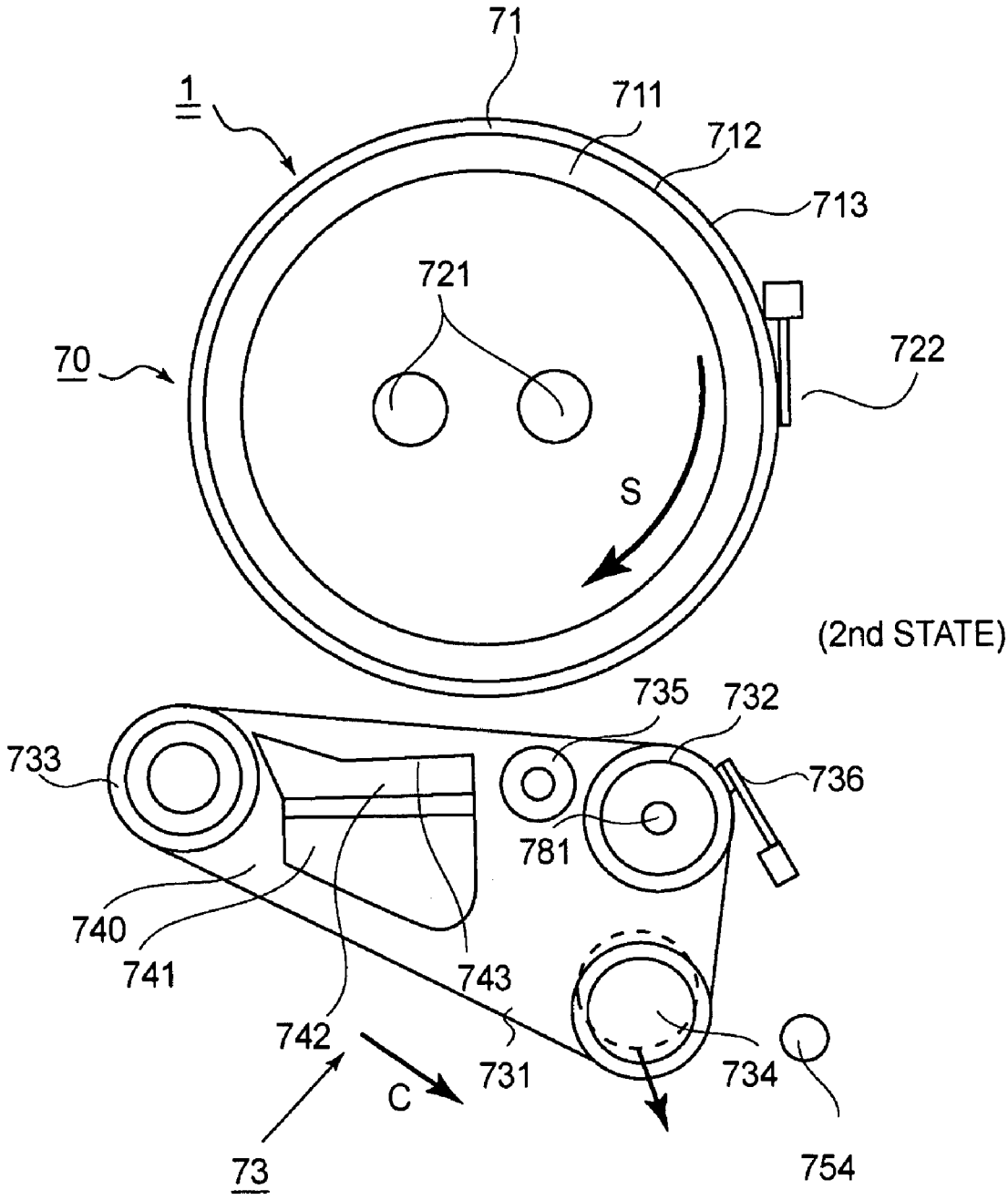
FIG. 4B is a schematic sectional view of the fixing apparatus in the first embodiment of the present invention, which is in the second state.

Referring to FIG. 4B, on the other hand, while the fixation roller 71 and fixation belt unit 73 are kept separated from each other (not kept pressed upon each other: second state), the top portion of the peripheral surface of the oil application roller 735 is below the line F (inside fixation belt loop and being away from fixation belt). Therefore, it is assured that the oil application roller 735 remains separated from the inward surface of the fixation belt 731. The separation of the oil application roller 735 from the fixation belt 731 prevents the oil application roller 735 from being contaminated by the particles resulting from the friction between inward surface of the fixation belt 731 and the pressure application pad 742 of the pressure application pad unit 740.

Figure 4C:
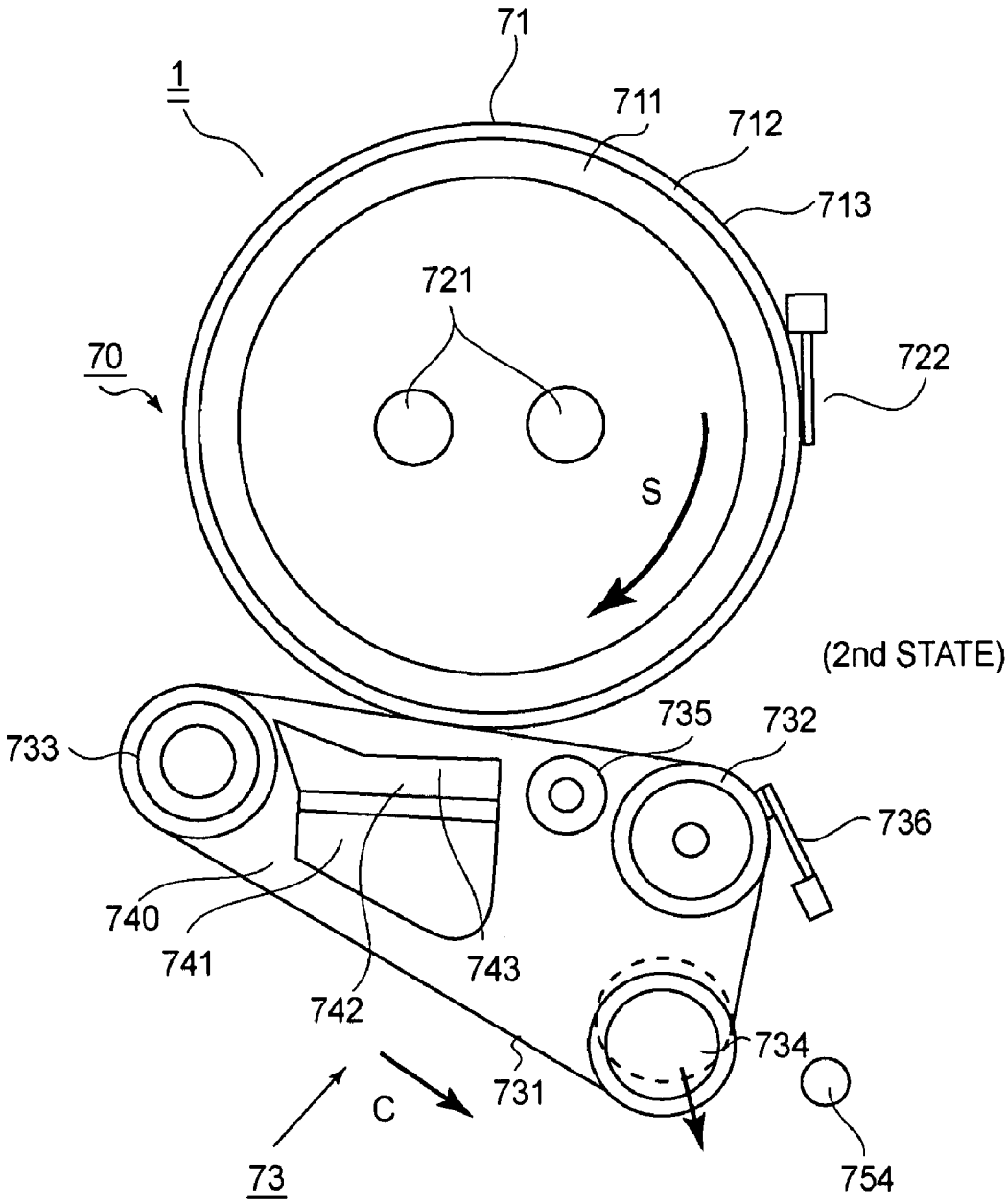
FIG. 4C is a schematic sectional view of the fixing apparatus structured differently from the fixing apparatus in the first embodiment of the present invention, which is in the second state.

While the apparatus is kept on standby, the fixation belt unit 73 does not need to be kept completely separated from the fixation roller 71 as described above. That is, the fixation belt unit 73 may be structured so that even while the fixing apparatus is kept on standby, the fixation belt unit 73 is not completely separated from the fixation roller 71, provided that the fixation belt unit 73 is moved in the direction to separate it from the fixation roller 71 by a distance large enough to substantially reduce the contact pressure between the fixation belt unit 73 and fixation roller 71. For example, the fixation belt unit 73 may be structured so that while the fixing apparatus is kept on standby, the positional relationship between the fixation belt 731 and fixation roller 71 is as shown in FIG. 4C. In this case, the pressure application pad unit 740 is separated from the fixation belt 731. Therefore, the frictional resistance to which the inward surface of the fixation belt 731 is subjected is small. Therefore, even though no oil is supplied to the fixation belt 731 from the oil application roller 735, it does not occur that the friction between the inward surface of the fixation belt 731 and the pressure application pad 742 interferes with the smooth rotation of the fixation belt 731. In other words, while the apparatus is kept on standby, the fixation belt unit 73 is not separated from the fixation roller 71. However, the pressure application pad 743 of the pressure application pad unit 740 is not kept pressed on the inward surface of the fixation belt 731 (FIG. 4C). Therefore, the oil application roller 735 is prevented from being contaminated. That is, as long as it is ensured that while the fixing apparatus is kept on standby, the oil application roller 735 is kept separated from the inward surface of the fixation belt 731 as it is in the case of the fixation belt unit 73, the fixation belt 731 of which is kept separated from the fixation belt 731 (FIG. 4B) while the apparatus is kept on standby, the fixation belt unit 73 may be structured so that even while the fixing apparatus is kept on standby, the fixation belt 731 remains in contact with the fixation roller 71. This structural arrangement also can prevent the oil application roller 735 from being contaminated with the particles resulting from the frictional wear of the fixation belt 731 and pressure application pad 743.

Figure 5:
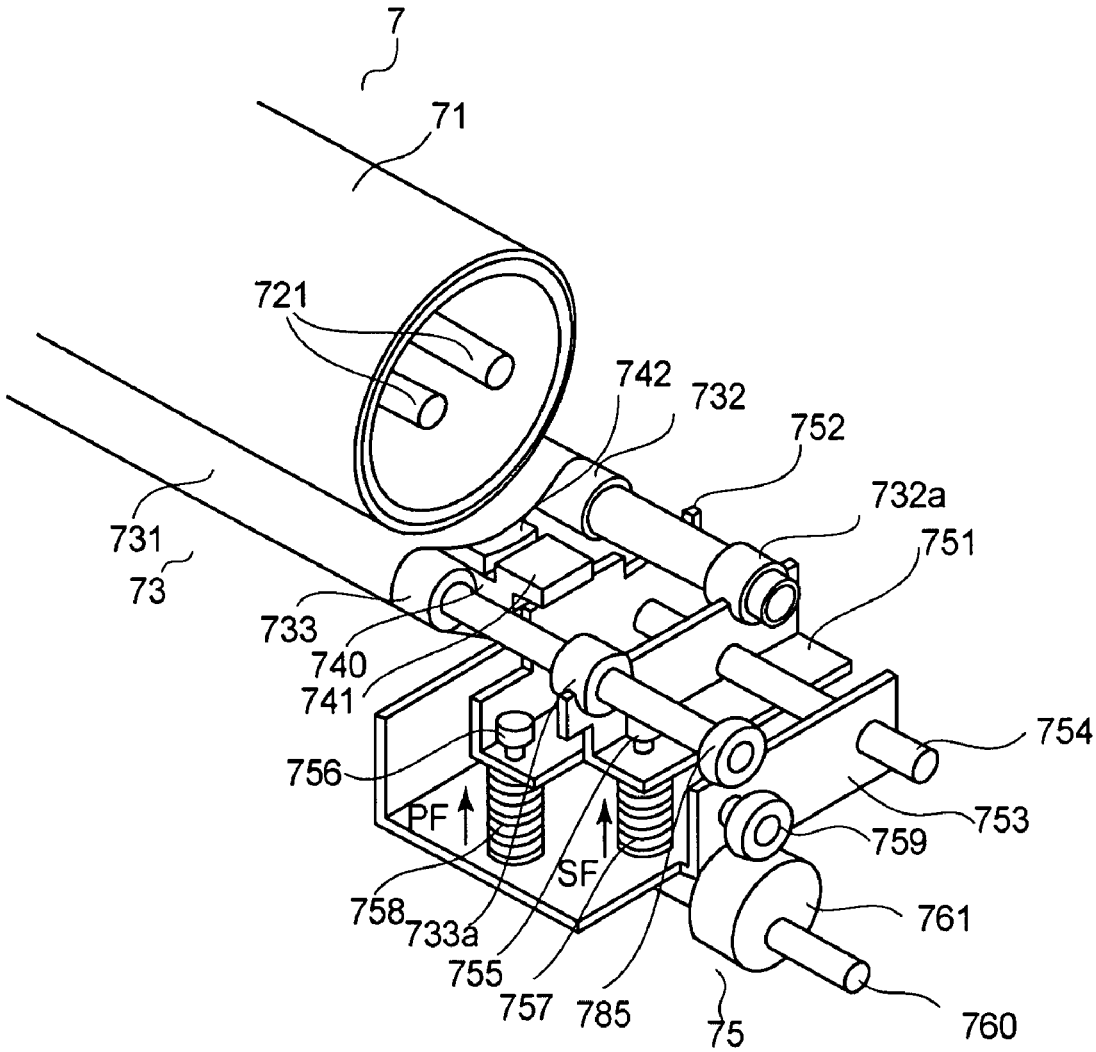
FIG. 5 is a perspective view of the pressure application mechanism.

Next, referring to FIG. 5, the mechanism for pressing the fixation belt unit 73 on the fixation roller 71 (mechanism for retracting fixation belt unit from fixation roller 71) will be described.

The fixation belt unit 73 is provided with a pair of pressure application mechanisms 75, which are disposed at the end portions of the fixation belt unit 73, one for one, in terms of the direction perpendicular to the recording medium conveyance direction. The two pressure application mechanism 75 are roughly the same in structure. Thus, one of them, which is shown in FIG. 5, will be described.

The one of the end portions of the entrance roller 732 is fitted with a bearing 732*a*, which is supported by a roller holder 751. The end portion of the separation roller 733 is fitted with a bearing 733*a*, which is also supported by the roller holder 751. Further, the end portion of the separation roller 733 is provided with a one-way clutch 733*b*, which is meshed with a gear 763 attached to a separation roller motor 762 attached to the roller holder 751. As the separation roller motor 762 rotates in the direction indicated by an arrow mark R, the one-way clutch 733*b* allows the separation roller motor 762 to rotate the separation roller 733, whereas as the separation motor 762 rotates in reverse, the one-way clutch 733*b* does not allow the separation roller motor 762 to rotates the separation roller 733.

The end portion of the base 741 of the pressure application pad unit 740 is rested on a pressure application pad unit holder 752.

Below the roller holder 751 and pressure application pad unit holder 752, a fixation belt unit holder 753 is disposed. The roller holder 751, pressure application pad unit holder 752, and fixation belt unit holder 753 are structured so that they are rotatable around an axle 754.

Between the fixation belt unit holder 753 and roller holder 751, a roller pressing spring 757 is disposed. A guide shaft 755 fixed to the fixation belt unit holder 753 is put through the roller pressing spring 757 and a hole with which the roller holder 751 is provided.

Between the fixation belt unit holder 753 and pressure application pad unit holder 752, a pressure application pad unit pressing spring 758 is disposed. A guide shaft 756 fixed to the fixation belt unit holder 753 is put through the pressure application pad unit pressing spring 758 and a hole with which the pressure application pad unit holder 752 is provided.

The pressure application holder 753 is provided with a cam follower 759, which is attached to the outward surface of the pressure application holder 753, in terms of the lengthwise direction of the fixation roller 71. Below the cam follower 759, a pressure application cam 761 is disposed, which is solidly attached to a rotational shaft 760.

Figure 6A:
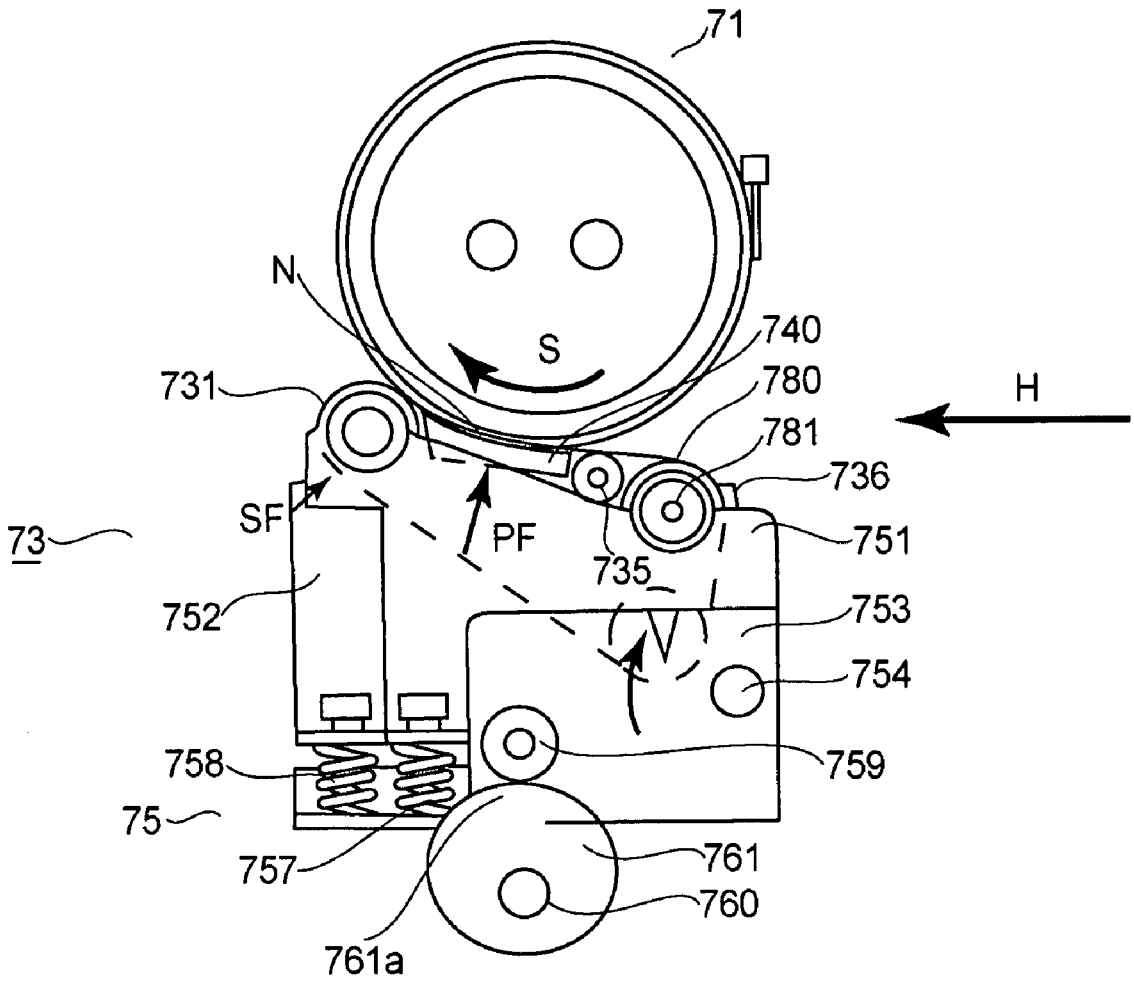
FIG. 6A is a side view of the pressure application mechanism, showing the state thereof when the fixing apparatus in the first state.
Figure 6B:
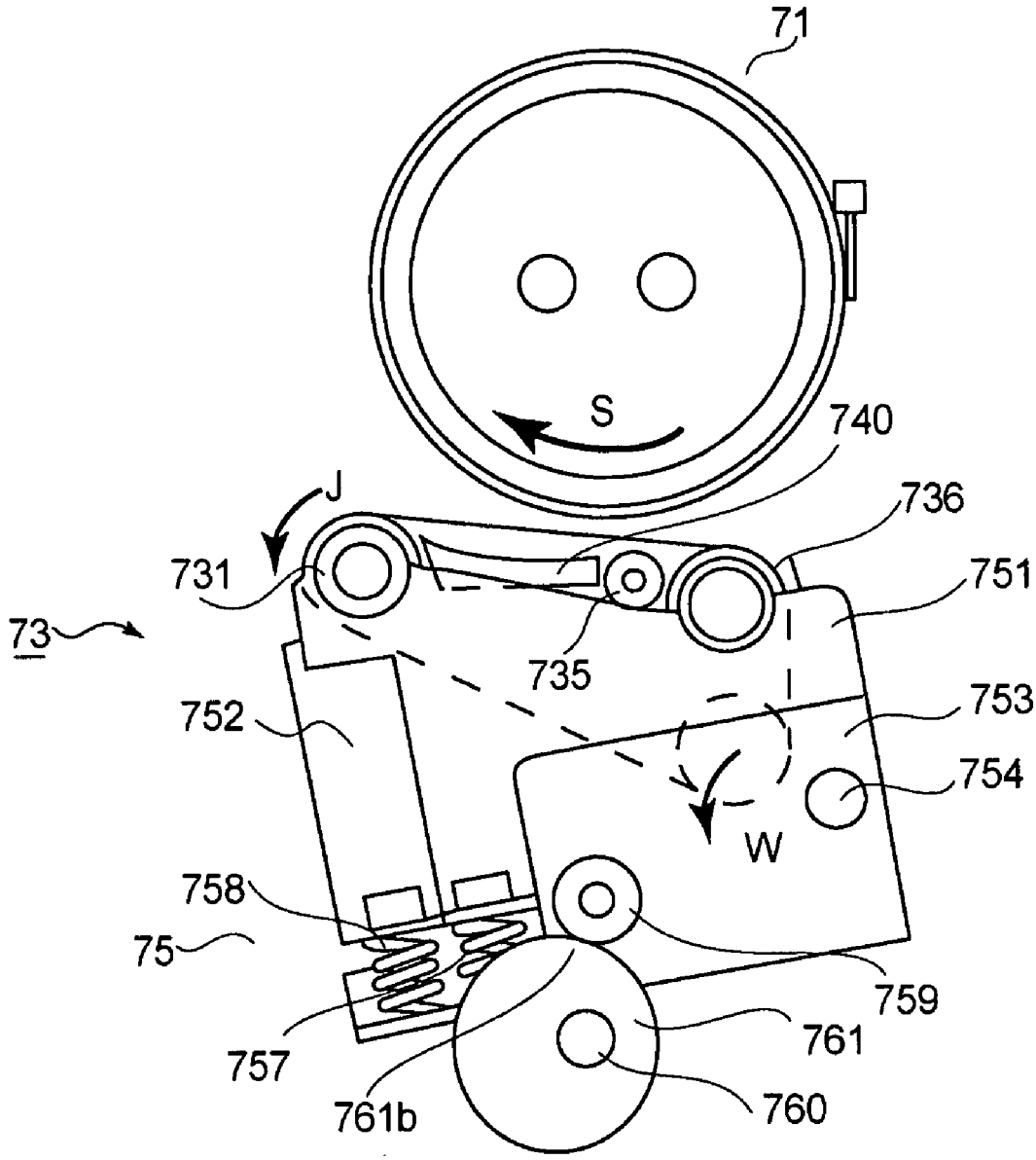
FIG. 6B is a side view of the pressure application mechanism, showing the state thereof when the fixing apparatus is in the second state.

FIG. 6A shows the fixing apparatus in this embodiment, which is in the state (first state) in which its fixation belt unit 73 is kept pressed upon its fixation roller 71, and FIG. 6B shows the fixing apparatus in this embodiment, which is in the state (second state; fixation belt unit 73 is not in contact with fixation roller 71) in which its fixation belt unit 73 has been retracted from its fixation roller 71.

Referring to FIG. 6*a*, as the rotational shaft 760 is rotated by an unshown driving system, the pressure application cam 761 rotates about the axial line of the rotational shaft 760. As the rotation of the pressure application cam 760 moves the point of the peripheral surface of the pressure application cam 760, which correspond to the, the largest distance between the peripheral surface of the pressure application cam 760 and the rotational axis of the shaft 760, toward the contact point between the pressure application cam 761 and cam follower 759, the cam follower 759 is pushed upward, causing the pressure application pad unit holder 753 to rotated about the axle 754 in the direction indicated by an arrow mark V. This allows the roller holder pressing spring 757 to rotate the roller holder 751 about the axle 754, causing thereby the separation roller 731 to be pressed against the fixation roller 71. At the same time, the pressure application pad unit holder 752 is rotated about the axle 754 by the pressure application pad unit pressing spring 758. As a result, a pressure PF is applied to the fixation pad unit 740, causing the fixation pad unit 740 to be pressed against the fixation roller 71.

As the fixation roller 71, which is under the above described condition, is rotated, the fixation belt 731 is rotated by the rotation of the fixation roller 71 in the direction indicated by an arrow mark G. During this period, the motor for the separation roller 731 remains stationary. Therefore, the separation roller 731 is allowed by the one-way gear 733 to be rotated by the rotation of the fixation belt 731.

Recording medium is conveyed from the direction indicated by an arrow mark H to the nip N between the fixation roller 71 and fixation belt 731, and is conveyed through the nip N, remaining pinched by the fixation roller 71 and fixation belt 731. While the recording medium is conveyed through the nip N, the toner on the recording paper is melted by the heat from the fixation roller 71 and fixation belt 731, and is pressed upon the recording paper by the pressured applied by the pressure application pad unit 740. As a result, the toner is fixed.

Referring to FIG. 6B, as the pressure application cam 761 is rotated about the rotational shaft 760 by the unshown driving system so that the point of the peripheral surface of the pressure application cam 761, which corresponds to the shortest distance between the peripheral surface of the pressure application cam 761 and the axial line of the shaft 760, moves to the contact point between the pressure application cam 761 and cam follower 759, the cam follower 759 is allowed to move downward from the above described position, allowing the pressure application pad unit holder 753 to rotate about the rotational shaft 754 in the direction indicated by an arrow mark W. Therefore, the force generated by the resiliency of the roller pressing spring 757 is blocked by the stopper portion of the guide shaft 755, allowing the roller holder 751 to rotate about the rotational shaft 754. As a result, the separation roller 731 separates from the fixation roller 71. Similarly, the force generated by the resiliency of the pressure application pad unit pressing spring 758 is blocked by the stopper portion of the guide shaft 756, allowing the pressure application pad unit holder 752 to rotate about the rotational shaft 754. As a result, the fixation pad unit 740 separates from the fixation roller 71. During this period, the oil application roller 735 remains separated from the inward surface of the fixation belt 731, as will be evident from FIG. 6B.

While the fixing apparatus is kept on standby, for example, while no recording medium is fed, or the fixing apparatus is waiting for the output from the image forming stations, the fixation belt unit 73 is kept in the above described position (kept in the second state), keeping thereby the fixation belt 731, separation roller 731, and pressure application pad unit 740 separated from the fixation roller 71. If the fixation belt 731 is kept stationary in this state, only the portion of the fixation belt 731, which is in contact with the entrance roller 732, is increased in temperature by the heat from the belt heater 781. Therefore, the separation roller motor 762 is rotated in the direction indicated by an arrow mark R (FIG. 5), causing thereby the fixation belt 731 to rotate in the direction indicated by an arrow mark J (FIG. 6B). During this period, there is not contact between the oil application roller 735 and the inward surface of the fixation belt 731, and therefore, the inward surface of the fixation belt 731 is not supplied with oil. However, the pressure application pad unit 740 is not in contact with the fixation roller 71. Therefore, even though the inward surface of the fixation belt 731 is not supplied with oil, the frictional resistance to which the inward surface of the fixation belt 731 is subjected is very small. Therefore, the inward surface of the fixation belt 731 is prevented from being subjected to serious frictional wear.

As described above, while the fixing apparatus is kept on standby, the fixation roller 71 is not in contact with the fixation belt 731 and oil application roller 735. Therefore, the structural arrangement, in this embodiment, for the fixing apparatus extends the service life of the oil application roller 735.

Embodiment 2

FIG. 7 is a drawing depicting the fixing apparatus in the second embodiment of the present invention. The lengthwise end portions of the oil application roller 735 are supported by a pair of lever 200, one for one. Each lever 200 is rotatable about the shaft 201 with which the fixation belt unit 73 is provided. The one end 200*a* of the lever 200 can be placed in contact with a stationary stopper 202 with which the fixing apparatus is provided.

Figure 7A:
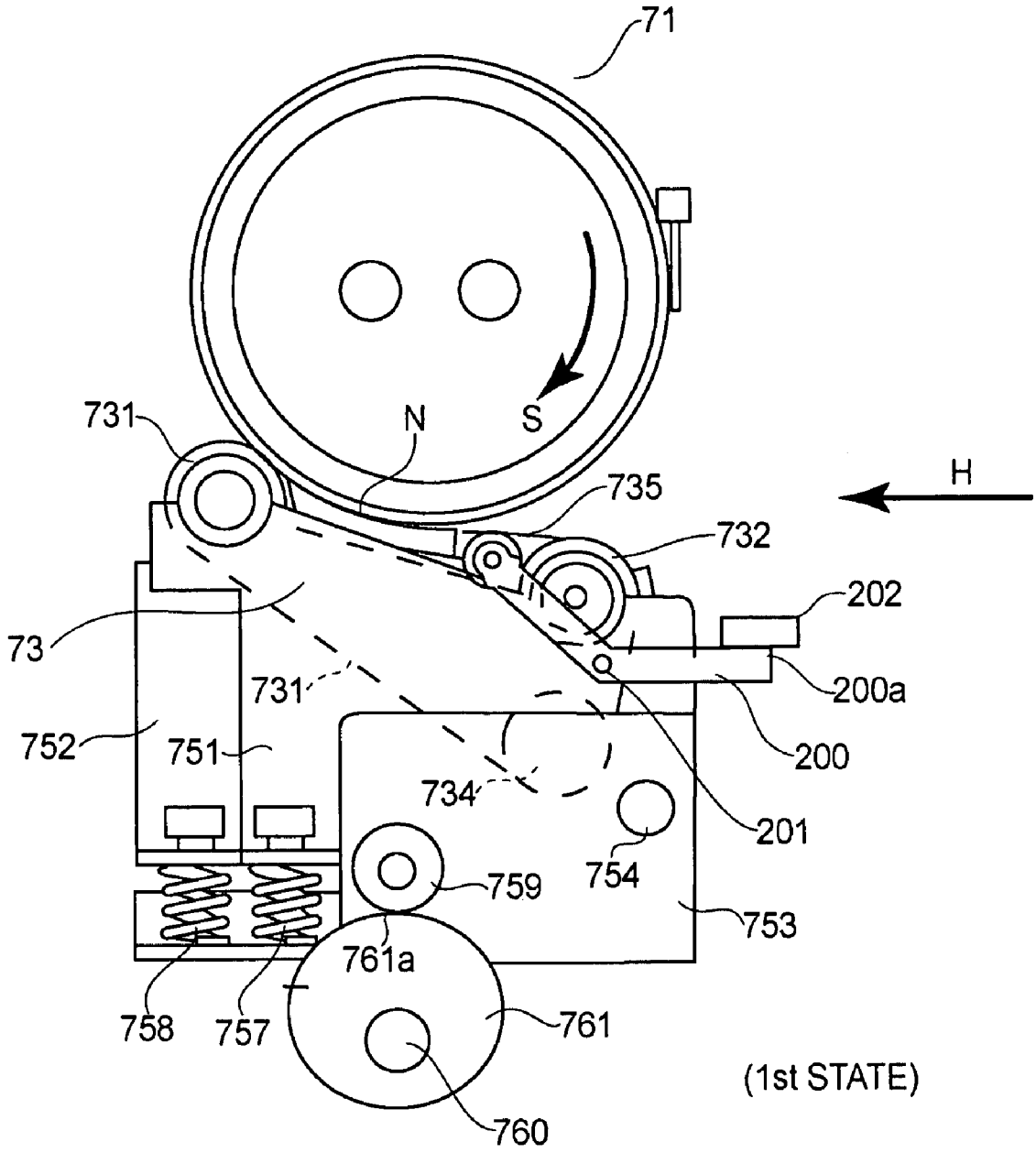
FIG. 7A is a schematic sectional view of the fixing apparatus in the second embodiment of the present embodiment, which is in the first state.

FIG. 7A shows the state (first state) of the fixing apparatus, in which the fixation belt unit 73 is kept pressed upon the fixation roller 71. When the fixing apparatus is in this state, the shaft 201 of the lever 200 is at roughly the same level as the stopper 202; the lever 200 has rotated in the direction to place the oil application roller 735 in contact with the inward surface of the fixation belt 731. In other words, when the fixing apparatus is in this state, the oil application roller 735 is in contact with the inward surface of the fixation belt 731.

Figure 7B:
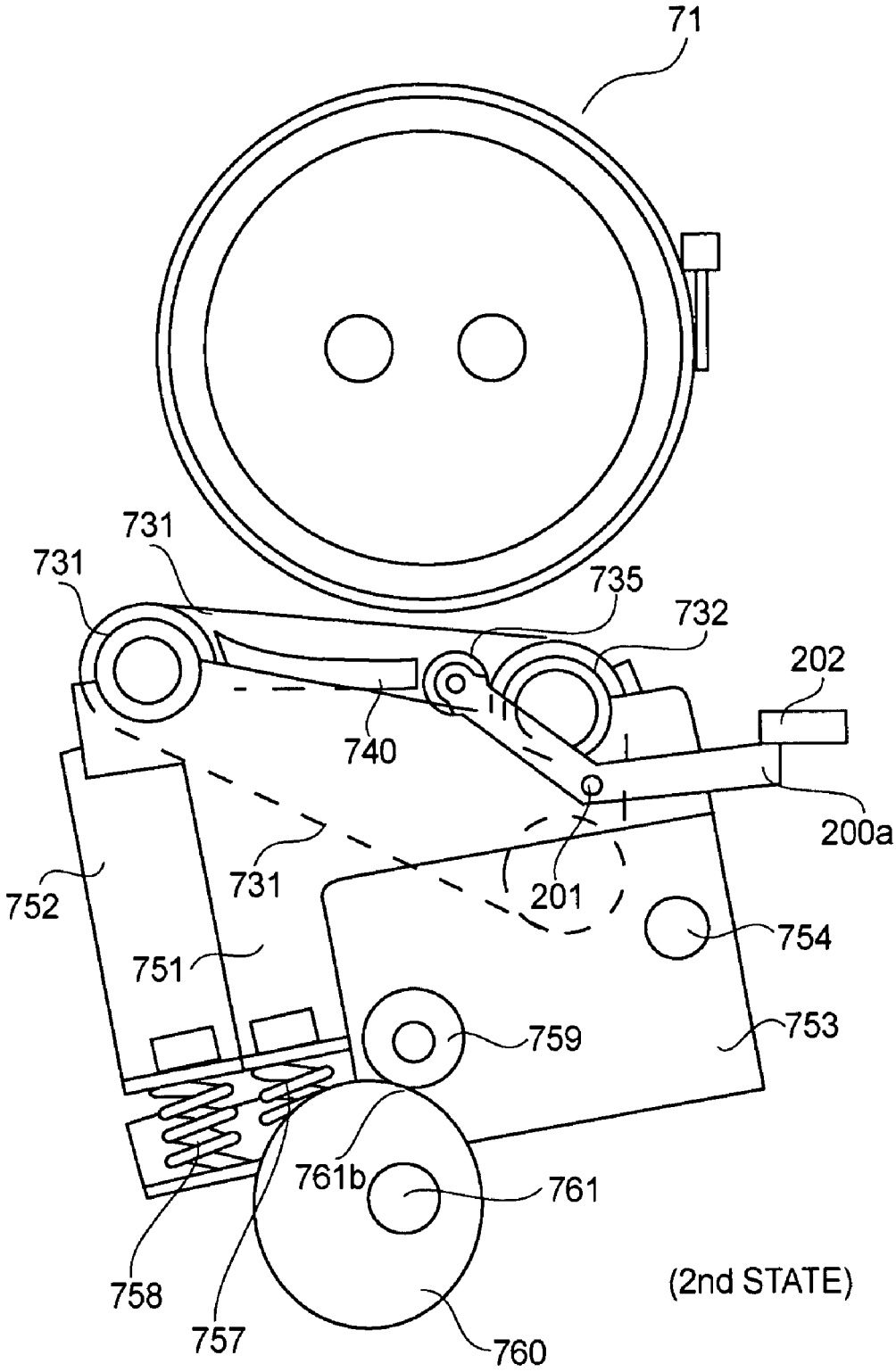
FIG. 7B is a schematic sectional view of the fixing apparatus in the second embodiment of the present embodiment, which is in the second state.

FIG. 7B shows the state (second state) of the fixing apparatus, in which the fixation belt unit 73 is not in contact with the fixation roller 71. When the state of the fixing apparatus is changed from the first to the second, the shaft 201 of the lever 200 is moved downward to a level which is slightly lower than that of the stopper 202. As a result, the lever 200 is rotated by its own weight in the direction to separate the oil application roller 735 from the inward surface of fixation belt 731. Therefore, the oil application roller 735 separates from the inward surface of the fixation belt 731.

As the state of the fixing apparatus is changed from the first state shown in FIG. 7A to the second state shown in FIG. 7B, the oil application roller 735 moves in the direction to separate from the inward surface of the fixation belt 731. Further, as the state of the fixing apparatus is changed from the second state shown in FIG. 7B to the first state shown in FIG. 7A, the oil application roller 735 moves in the direction to contact the inward surface of the fixation belt 731.

Structuring the fixing apparatus as described above yields the same effects as those yielded by the first embodiment.

In the case of the structural arrangement described above, when the belt is not in contact with the heating roller (after belt is retracted from heat roller 71), the lubricant application member is kept separated from the inward surface of the belt. Therefore, it does not occur that while the fixing apparatus is kept on standby or in the like state, the surface of the lubricant application member is contaminated. Therefore, the lubricant application member lasts longer. In other words, the structural arrangement described above extends the service life of the lubricant application member. Further, the structural arrangement described above ensures that while the belt is kept pressed on the rotational heating member, for example, during a copying operation, lubricant is consistently and satisfactorily applied to the belt, ensuring thereby that the satisfactory image heating operation is consistently carried out for a long time.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 265875/2005 filed Sep. 13, 2005 which is hereby incorporated by reference.

What is claimed is:

1. An image heating apparatus comprising:

a heating rotatable member for heating an image on a recording material at a nip;

an endless belt cooperative with said heating rotatable member to form the nip;

a pressing pad for pressing said belt at the nip; and a lubricant application member for applying a lubricant on an inner surface of said belt, wherein said lubricant application member is away from said belt when said belt is at a position retracted from a position where an image heating operation of said apparatus is capable.

2. An apparatus according to claim 1, wherein said lubricant application member is disposed stationarily on said apparatus inside said belt.

3. An apparatus according to claim 1, further comprising first and second rollers for providing a surface of said belt contacting said heating rotatable member, wherein said lubricant application member is disposed at a position which is remote from such a common tangent line of said first and second rollers as is near to said heating rotatable member in a direction away from said heating rotatable member.

4. An apparatus according to claim 3, further comprising a mechanism for moving said lubricant application member away from said belt in interrelation with a retracting operation of said belt from said heating rotatable member.

5. An apparatus according to claim 1, wherein said lubricant application member includes a rotatable member having a layer which is impregnated with the lubricant.

* * * * *